US012577634B2

(12) United States Patent
Kittelty et al.

(10) Patent No.: US 12,577,634 B2
(45) Date of Patent: Mar. 17, 2026

(54) MICROBIAL-ASSISTED HEAP LEACHING

(71) Applicant: TECHNOLOGICAL RESOURCES PTY. LIMITED, Melbourne (AU)

(72) Inventors: Daniel Arthur Kittelty, Glenroy (AU); Ralph Peter Hackl, Hope Island (AU); Yaqiong Ren, Southbank (AU); Paul Leslie Brown, Kiama (AU)

(73) Assignee: TECHNOLOGICAL RESOURCES PTY LIMITED, Melbourne (AU)

( * ) Notice: Subject to any disclaimer, the term of this patent is extended or adjusted under 35 U.S.C. 154(b) by 0 days.

(21) Appl. No.: 18/227,365

(22) Filed: Jul. 28, 2023

(65) Prior Publication Data

US 2024/0035113 A1 Feb. 1, 2024

(30) Foreign Application Priority Data

Jul. 28, 2022 (AU) ..... 2022902120
Apr. 6, 2023 (AU) ..... 2023901012

(51) Int. Cl.
*C22B 3/18* (2006.01)
*C22B 1/16* (2006.01)
(Continued)

(52) U.S. Cl.
CPC ..... *C22B 3/18* (2013.01); *C22B 1/16* (2013.01); *C22B 3/02* (2013.01); *C22B 3/08* (2013.01);
(Continued)

(58) Field of Classification Search
CPC .... C22B 3/18; C22B 1/16; C22B 3/02; C22B 3/08; C22B 15/0006; C22B 15/0071;
(Continued)

(56) References Cited

U.S. PATENT DOCUMENTS 7,575,622 B2 * 8/2009 Crundwell ..... C22B 15/0071 75/743
2018/0119247 A1 5/2018 Engdahl Toledo et al.
(Continued)

FOREIGN PATENT DOCUMENTS

CN 101984094 B 7/2014
CN 108368563 A * 8/2018 ..... C22B 1/14
(Continued)

OTHER PUBLICATIONS

Sep. 13, 2022—(AU) International-type search for provisional patent application—App 2022902120.
(Continued)

*Primary Examiner* — Danielle M. Carda
(74) *Attorney, Agent, or Firm* — Banner & Witcoff, Ltd.

(57) ABSTRACT

Microbial-assisted heap leaching of fragments or agglomerates of fragments of copper-containing sulfidic ores, such as chalcopyrite ores, and copper-containing sulfidic waste materials is disclosed. A heap leaching method includes controlling the sulfate concentration in a leach liquor. When heap leaching includes using agglomerates, a method of forming agglomerates includes adding the feed materials at, or close to, the inlet end, typically no more than 40%, typically no more than 30%, more typically no more than 20%, of the length from the inlet end of the agglomeration unit.

19 Claims, 4 Drawing Sheets

(51) Int. Cl.
*C22B 3/02* (2006.01)
*C22B 3/08* (2006.01)
*C22B 15/00* (2006.01)

(52) U.S. Cl.
CPC ..... *C22B 15/0006* (2013.01); *C22B 15/0071* (2013.01); *C22B 15/0097* (2013.01)

(58) Field of Classification Search
CPC . C22B 15/0097; C22B 15/0067; C22B 7/007; C22B 19/22; C22B 23/0415; Y02P 10/20
USPC ..... 75/743
See application file for complete search history.

(56) References Cited

U.S. PATENT DOCUMENTS

| | | | | |
|---|---|---|---|---|
| 2019/0127822 | A1* | 5/2019 | Hackl | C22B 1/14 |
| 2019/0345580 | A1 | 11/2019 | Kittelty et al. | |
| 2019/0382869 | A1* | 12/2019 | Brown | C22B 15/0067 |
| 2022/0033933 | A1 | 2/2022 | Fennel et al. | |

FOREIGN PATENT DOCUMENTS

| | | | |
|---|---|---|---|
| EP | 0522978 | A1 | 1/1993 |
| GB | 1528061 | A | 10/1978 |
| WO | 2000/071763 | A1 | 11/2000 |
| WO | 2004027099 | A1 | 4/2004 |
| WO | 2009000037 | A1 | 12/2008 |
| WO | 2017/070747 | A1 | 5/2017 |
| WO | 2018/072029 | A1 | 4/2018 |
| WO | 2018/184071 | A1 | 10/2018 |
| WO | 2022/056622 | A1 | 3/2022 |
| WO | 2024020653 | A1 | 2/2024 |

OTHER PUBLICATIONS

Watling, H. R., Watkin, E. L. J., & Ralph, D. E. (2010). The resilience and versatility of acidophiles that contribute to the bio-assisted extraction of metals from mineral sulphides. Environmental Technology, 31(8-9), 915-933.

Bouffard, S. C. (2008). Agglomeration for heap leaching: Equipment design, agglomerate quality control, and impact on the heap leach process. Minerals Engineering, 21(15), 1115-1125.

Bennett, J. W., & Ritchie, A. I. M. (2004). A proposed technique for measuring in situ the oxidation rate in biooxidation and bioleach heaps. Hydrometallurgy, 72(1-2), 51-57.

Oct. 31, 2023—(WO) International Search Report—App PCT/AU2023/050708.

May 22, 2024—(WO) International Preliminary Report on Patentability—PCT/AU2023/050708.

Sep. 12, 2025—(CL) 2nd Office Action—App. No. 202302242.

Basson et al. The effect of sulphate ions and temperature on the leaching of pyrite. III. Bioleaching. (2013) Hydrometallurgy, 133, 176-181.

Meruane et al., "Design criteria for the solution circuit in the Bacterial leaching of copper sulfides in heaps", Electrometallurgy Departments of Mining Engineering and Chemical Engineering; 6 pages; (1999).

* cited by examiner

MICROBIAL-ASSISTED HEAP LEACHING

CROSS-REFERENCE TO RELATED APPLICATIONS

This application claims priority to Australian Patent Application 2022902120, filed Jul. 28, 2022 and Australian Patent Application 2023901012, filed Apr. 6, 2023, each of which is incorporated herein by reference in its entirety.

TECHNICAL FIELD

The present invention relates to microbial-assisted heap leaching of a base metal, such as copper or nickel or zinc or cobalt, from fragments of a base metal sulfide-containing sulfidic material, where the term "material" includes, for example, ores and waste materials such as tailings.

The term "ore" is understood herein to mean natural rock or sediment that contains one or more valuable metals that can be mined, reclaimed, treated and sold at a profit.

The present invention relates particularly, although not exclusively, to microbial-assisted heap leaching of fragments of copper-containing sulfidic ores, such as sulfidic ores that contain copper minerals such as chalcopyrite ($CuFeS_2$), enargite ($Cu_3AsS_4$), tetrahedrite (Cu,Fe,Zn, $Ag_{12}Sb_4S_{13}$), tennantite ($Cu_{12}As_4S_{13}$), bornite ($CuSFeS_4$), chalcocite ($Cu_2S$) and covellite (CuS) or any combination thereof, or other copper containing sulfide minerals and noting that the fragments may be fragments of (a) run-of-mine ("ROM") ore or (b) ROM ore that has been subjected to intermediate processing, as the terms "ROM ore" and "intermediate processing" are understood herein.

The present invention also relates particularly, although not exclusively, to microbial-assisted heap leaching agglomerates of fragments of copper-containing sulfidic ores, such as those described in the preceding paragraph, noting that the fragments may be fragments of (a) ROM ore or (b) ROM ore that has been subjected to intermediate processing.

The present invention also relates particularly, although not exclusively, to microbial-assisted heap leaching of fragments of copper-containing sulfidic waste material, such as tailings, containing the above-mentioned minerals, noting that the fragments may be fragments of (a) ROM waste materials or (b) ROM waste materials that have been subjected to intermediate processing.

The present invention also relates particularly, although not exclusively, to the construction of a heap (and a constructed heap) that is configured to optimise microbial activity.

BACKGROUND ART

In conventional heap leaching of copper-containing sulfidic ores (including chalcopyrite ores), ore is stacked in heaps, aerated through direct injection of air via aeration pipes extending into the heap and/or by natural convection through exposed areas of the heap, and irrigated with an acid solution for extraction of copper into solution. The leaching process requires an acid and an oxidant to dissolve copper into solution. The copper is subsequently recovered from the acidic solution by a range of recovery options including for example solvent extraction and electrowinning (SX/EW), cementation onto more active metals such as iron, hydrogen reduction, and direct electrowinning. The acid solution is regenerated and recycled through the heap to leach more copper from the ore in the heap. The ore in the heap may comprise agglomerates of fragments of ore. Leaching may be assisted by the addition of ferrous and sulfur oxidizing microorganisms.

Generally, heap leaching (which is understood herein to include dump leaching) provides lower metal recoveries than other metallurgical process options for recovering copper from copper-containing ores, such as milling and flotation that produces copper-containing concentrates that are then smelted to produce copper metal.

Consequently, heap leaching tends to be reserved for lower grade ore types that have at least a proportion of readily recoverable copper, but where crushing/milling costs per unit of copper (or copper equivalent—i.e., when taking into account by-product credits from, for example, gold and silver) are too high to support a concentrator approach, or where mineral liberation and other characteristics (e.g., arsenic content) will not support production of directly useable or saleable concentrates.

Standard best industry practice is to use agglomerates of mined and thereafter comminuted, for example crushed, ore fragments in heaps. Typically, the mined ore is processed through multiple crushing steps, such as primary and secondary crushing steps, and in some instances tertiary and other crushing steps, and the crushed ore fragments are agglomerated in an agglomeration step, typically with the use of an acid. The following description focuses on chalcopyrite ores.

The term "chalcopyrite ores" is understood herein to mean ores that contain chalcopyrite. The ores may also contain other copper-containing minerals. The ores may also contain pyrite.

The description is equally applicable to other copper-containing minerals in ores or waste materials, such as those mentioned under the heading "Technical Field" and is not confined to chalcopyrite ores.

It is known that it is difficult to leach more than 20-40 wt. % of the total copper from chalcopyrite by heap leaching.

The low copper recovery is often thought to be associated with the formation of a passive film on the surface of chalcopyrite in chalcopyrite ores.

The applicant has carried out extensive research and development work into leaching chalcopyrite ores (and other copper-containing sulfidic ores) and has made a series of inventions, including the inventions described and claimed in International applications PCT/AU2016/051024, PCT/AU2018/050316, PCT/AU2019/050383, PCT/US2021/043869, PCT/AU2008/000928 and PCT/US2021/43899 in the name of the applicant.

The disclosures in the International applications are incorporated herein by cross-reference.

The disclosure herein is concerned with addressing at least some of the technical issues identified in the research and development work.

The above description is not to be taken as an admission of the common general knowledge in Australia or elsewhere.

SUMMARY OF THE DISCLOSURE

Inventions Made in the Research and Development Work

The applicant has identified a series of further inventions in the above-mentioned research and development work.

The inventions relate generally to microbial-assisted heap leaching of a base metal sulfide-containing sulfidic material, noting that copper is a base metal of particular, although not the only, interest to the applicant.

In embodiments of particular interest to the applicant, the inventions relate to microbial-assisted heap leaching of fragments or agglomerates of fragments of copper-containing sulfidic ores, such as chalcopyrite ores, and copper-containing sulfidic waste materials.

In embodiments of particular interest to the applicant, the inventions relate to:

(a) microbial-assisted heap leaching of fragments of copper-containing sulfidic ores and copper-containing sulfidic waste materials with high sulfate concentrations in the leach liquor; and (b) microbial-assisted heap leaching of agglomerates of the item (a) fragments; and (c) adding microbes (also known as microorganisms, bacteria or archaea) to fragments of copper-containing sulfidic ores and copper-containing sulfidic waste materials.

The term "fragment" is understood herein to mean a part of a mined (i.e., run-of-mine "ROM") material or an intermediate processed (such as comminuted, for example crushed) ROM material, where the term "material" includes ores and waste materials, which may be stockpiled ores and waste materials that have been reclaimed.

It is noted that the term "fragment" as used herein may be understood by some persons skilled in the art to be better described as "particles" and "broken rocks". The intention is to use these terms as synonyms.

The fragments may be fragments of ROM material, which may be ROM ore or ROM waste materials, that are transferred from a location in a mine in which the ROM material is mined:

i. directly to the heap; or ii. directly to a stockpile and then transferred later directly to the heap; or iii. for intermediate processing as described herein and then transferred to the heap; or iv. for intermediate processing as described herein and then transferred to a stockpile and then transferred later to the heap; or v. directly to a stockpile and then transferred for intermediate processing as described herein and then transferred to the heap; or vi. a combination of the preceding options iv. and v. with intermediate processing before and after the stockpile.

The term "intermediate processing" relates to any type of processing of ROM material including processing that falls under the general description of "ore dressing" including but not limited to any one or more of comminution, size separation into different size fractions, sorting by grade of a target base metal (e.g., concentration of the base metal) into different grade fractions, sorting by other mineralogical composition of the ROM material (such as a contaminant), sorting by other property of the ROM material, and agglomeration.

It is noted that the ROM material may be fragments that are reduced in size from larger fragments as a consequence of mining and transferring ROM material from a mine to a heap, a stockpile or an intermediate processing plant, and not as a consequence of a specific comminution or other intermediate processing step.

For example, the size reduction may be a consequence of larger fragments breaking during slumping into a pit floor in a drill and blasting mining operation in an open pit mine and transferring slumped fragments by excavators and other materials handling equipment to a heap, a stockpile or an intermediate processing plant, and not as a consequence of a specific comminution or other intermediate processing step.

By way of further example, the size reduction may be a consequence of fragments breaking down as they are removed from draw points of a block cave mine by front end loaders or other excavators and are transported to a heap, a stockpile or an intermediate processing plant, and not as a consequence of a specific comminution or other intermediate processing step.

The ROM material may have a particle size in any suitable range.

For example, the ROM material may have a particle size in a range between a P80 of 30 mm and a P80 of 2000 mm. The ROM material particle size range may be any suitable range within this broad range having regard to the characteristics of a given mine. For example, the ROM material particle size range may be a wide range such as between a P80 of 50 and a P80 of 1000 mm. For example, the ROM material particle size range may be a narrower range such as, typically in a range between a P80 of 30 and a P80 of 60 mm.

The ROM material and the intermediate processed material may have any suitable particle shape, noting that specified particle size ranges are based on one dimension only.

In a situation in which the ROM material has been comminuted in an intermediate processing step, by way of example only, the comminuted ROM material may have a particle size in a range between a P80 of 5 mm and a P80 of 30 mm.

Microbial-Assisted Leaching from Copper-Containing Sulfidic Materials

The extraction of copper from materials in the form of copper-containing sulfidic ores and copper-containing sulfidic waste materials requires an oxidant and an acid. Industrially, ferric ions are used as an oxidant, and sulfuric acid is used as an acid. During the process of mineral dissolution, ferric ions are reduced to ferrous ions and sulfuric acid is consumed during reactions with gangue minerals. Microorganisms oxidise ferrous ions, generating ferric ions, as well as oxidising available solid and soluble sulfur compounds, generating sulfuric acid.

Maintaining sufficient rates of iron and sulfur oxidation to facilitate optimal copper extraction requires a microbial population in an inhabitable environment and with any required nutrients.

The mechanisms of mineral sulfide dissolution of copper-containing sulfidic ores and copper-containing sulfidic waste materials depend upon the presence of ferric ions and acid to break down the mineral matrix and solubilise metals. Ferric ions and acid are consumed during mineral oxidation, and dissolution rates will decrease unless they are replenished.

Under aerobic conditions, microbes (such as acidophilic bacteria and archaea) regenerate ferric ions and acid through biological oxidation of ferrous ions and sulfur compounds (including elemental sulfur):

$$2Fe^{2+}+2H^{+}+0.5O_2 \rightarrow 2Fe^{3+}+H_2O$$

$$2S+3O_2+2H_2O \rightarrow 2H_2SO_4$$

The sulfur compounds may be derived from oxidation of the sulfides or as an addition (such as, elemental sulfur). The sulfur compounds may be sulfur-containing inorganic compounds such as thiosulfate or polythionates or polysulfides, or sulfur-containing organic compounds such as thiourea or other thiocarbamides.

Not only do these reactions maintain concentrations of ferric ions and acid, they also serve to generate energy for the formation of additional cells, potentially making the process autocatalytic under conditions ideal for microbial reproduction.

During mineral dissolution of copper-containing sulfidic ores and copper-containing sulfidic waste materials, changing solution conditions impact the activity of microbes present in the leaching environment.

Research and development work of the applicant found that the rate of ferrous ion and sulfur oxidation is affected by high metal sulfate concentrations, fluctuations in solution pH, and changes in temperature.

Research and development work of the applicant also found that sulfide mineral dissolution (and therefore copper extraction) of copper-containing sulfidic ores and copper-containing sulfidic waste materials was negatively impacted if ferric ions and acid are not regenerated through microbial activity at a sufficient rate.

Impact of Aeration of a Heap

The applicant realised in the research and development work that oxygen influences a number of operating parameters of a heap including oxidation rate of the feed material, temperature, microbial activity and population in a heap.

For example, increasing air and consequently oxygen supply into a heap increases microbial activity which in turn increases the temperature of the heap, oxidation of ferrous ions into ferric ions and oxidation of sulfur compounds into sulfuric acid.

The applicant found in the research and development work that controlling the sulfate concentration in a leach liquor is an important consideration in a method of microbial-assisted heap leaching copper-containing sulfidic ores and copper-containing sulfidic waste materials and that air and/or oxygen flow rate during aeration of a heap may be used as one option to influence the sulfate concentration in a leach liquor.

Adding Microbes During Agglomeration

The applicant also found in the research and development work that the formation of agglomerates of fragments of copper-containing sulfidic ores and copper-containing sulfidic waste materials with microbes in the agglomerates requires careful control of an agglomeration unit and that this can be achieved by ensuring that feed materials for agglomeration are provided at, or close to, an inlet of an agglomeration unit and form agglomerates a short distance, as described herein, along the length of the unit.

It is noted that the inventions are not confined to agglomerating fragments of material.

It is also noted that the inventions extend to embodiments in which microbes are added to agglomerates and heap leach operations after agglomerates have formed.

Invention 1

The invention is based on the finding mentioned above that controlling the sulfate concentration in a leach liquor is an important consideration in a method of microbial-assisted heap leaching copper-containing, sulfidic ores and copper-containing sulfidic waste materials.

Embodiments of the invention are also based on a finding, although the invention is not limited to the finding, that thermophilic microorganisms that are active at temperatures exceeding 45° C. are more sensitive to high sulfate concentrations than are mesophilic microorganisms that are most active at temperatures in the 20-40° C. range.

These findings led to the applicant developing a high sulfate generating heap leach process that can be operated at elevated heap temperatures as high as 85° C. (for example, 60-65° C.), with the advantages of elevated temperature operation.

The invention provides a method of microbial-assisted heap leaching copper-containing sulfidic ores or copper-containing sulfidic waste materials which includes: supplying an acidic leach liquor containing sulfates to a heap of fragments of copper-containing sulfidic ores or copper-containing sulfidic waste materials or agglomerates of the fragments and allowing the leach liquor to flow through the heap and leach copper, collecting leach liquor from the heap, and processing the collected leach liquor and recovering copper from the leach liquor, with any one or more of the fragments, agglomerates of the fragments (when present), and the leach liquor containing microbes, and the method comprising controlling a sulfate concentration in the leach liquor so that it does not exceed a threshold concentration (described further below).

The invention also provides the method described in the preceding paragraph as applied generally to base metal-containing sulfidic ores or base metal-containing sulfidic waste materials.

Significantly, the applicant has found that it is possible to operate a microbially-assisted heap leach of fragments of copper-containing sulfidic ores or copper-containing sulfidic waste materials or agglomerates of such fragments, in both cases with or without intermediate processing as described herein, even with high sulfate concentrations (such as at least 60 g/L sulfate) in leach liquor, i.e., up to a threshold concentration.

Regeneration of ferric ions and acid at a commercially viable rate was observed by the applicant in the research and development work even when using thermophilic microorganisms at high sulfate concentrations. The observed ferric ions and acid generation in turn facilitated leaching of ores and waste materials.

This is a surprising result given reported research in the literature indicating that high sulfate concentrations have an adverse impact on microbial activity, i.e., biological oxidation of ferrous ions and sulfur compounds to regenerate ferric ions and protons.

The method may include controlling the method so that the sulfate concentration does not exceed a threshold sulfate concentration in the leach liquor by any one or more than one of dilution, chemical neutralisation, electrochemical neutralisation, solution bleeding, and physical separation techniques including nanofiltration.

The method may include monitoring the sulfate concentration in the leach liquor collected from the heap and controlling the method, as required, so that the sulfate concentration in the leach liquor does not exceed the threshold concentration.

The method may include indirectly controlling the sulfate concentration.

By way of example, the method may include indirectly controlling a parameter other than sulfate that influences the sulfate generation rate, such that changing the parameter causes a known change to the sulfate concentration.

In one example, the method may include controlling the aeration rate of the heap. The aeration rate may be set based on a predetermined oxygen utilisation of the heap, for example based on the feed composition.

In another example, the method may include controlling the pH in the heap in a range that induces precipitation of sulfate salts, such as jarosite.

The method is not confined to monitoring the sulfate concentration in the leach liquor collected from the heap and extends to other options for monitoring sulfate concentration.

In one example, the method may include monitoring either or both microbial activity and population.

The method may include measuring or modelling the oxygen utilisation of a heap.

The method may include controlling one or more of operating parameters based on the measured or modelled data to maintain the predetermined oxygen utilisation of the heap.

The method may include selecting an aeration rate of the heap based on a desired parametric value.

Examples of operating parameter values include an oxygen concentration of the heap, a carbon dioxide concentration of the heap, a temperature of leach liquor from the heap (i.e., a pregnant leach liquor temperature), temperature of the leach liquor (raffinate) being fed to the heap, a heap temperature, a pregnant leach liquor metal content, a pregnant leach liquor oxidation potential, ferric and ferrous iron concentrations, Eh value, a heap oxygen uptake rate, and a heap carbon dioxide uptake rate.

The method may include selecting an aeration rate of the heap based on a desired oxidation rate of the heap.

The method may include determining an oxidation rate of copper-containing sulfidic feed material as a function of any one or more of oxygen concentration of the heap, carbon dioxide concentration of the heap, a temperature of the leach liquor discharged from the heap (i.e., temperature of a pregnant leach liquor), raffinate feed temperature, a heap temperature, a pregnant leach liquor metal content, a pregnant leach liquor oxidation potential, ferric and ferrous iron concentrations, Eh value, a heap oxygen uptake rate, a heap carbon dioxide uptake rate, simulation based on at least one of feed composition, sulfide mineral leaching rates, heap geometry, environmental conditions external to the heap, and historical data from existing heaps.

One advantage of selecting an aeration rate based on a desired parametric value is that it provides greater operational control. For example, it ensures adequate supply of oxygen to the microbes to achieve the desired parametric value and avoids oversupplying oxygen which may incur unnecessary financial and energy expenses, for example, due to higher pumping or compressor (blower) requirements.

The method may include selecting an aeration rate of the heap based on a desired microbial population and/or activity.

The method may include selecting an aeration rate of the heap based on a desired heap temperature.

The method may include monitoring the temperature of the heap at different locations in the heap, noting that there may be variations of heap temperatures at different sections of the heap.

Suitably, the method includes monitoring the temperature at a point or points across the height of the heap, more suitably, ranging from 1-95% of the heap height below the heap surface.

Suitably, the method includes monitoring the temperature at a point or points across the width of the heap, more suitably, ranging from 1-95% of the heap width below the heap surface.

The temperature of the heap may be analogous to that of the pregnant leach liquor. As such, the method may include measuring the pregnant leach liquor temperature to indirectly measure the heap temperature.

The aeration rate may be controlled by controlling an irrigation rate. Suitably, the irrigation rate may be controllable using a rest-rinse cycle or varying the flowrate of the irrigant (e.g. acid).

A rinse step of a rest-rinse cycle involves flowing leach liquor through the heap. The rinse step may involve replacing pregnant leach liquor with fresh leach liquor.

A rest step of a rest-rinse cycle involves the cessation of the flow of leach liquor through the heap. The rest step may allow the microbes to equilibrate with the other components in the leach liquor. This may enhance copper dissolution into the leach liquor and improve the overall leaching process. The duration of a rest step may be less than the duration of a rinse step. The duration of a rest step may be the same as or longer than the duration of a rinse step.

The method may include aerating one of more lifts of the heap. Suitably, the method includes aerating each lift of the heap.

Aerating each lift of a heap minimises the risk of uneven distribution of oxygen throughout the heap. If aeration was only performed at the bottom of a heap, it is believed that oxygen would be consumed closer to the bottom of the heap as the air travels upwards. This would cause less oxygen to be available to lifts further up the heap, and potentially starve microbes of oxygen in these lifts.

The threshold sulfate concentration may be dependent in any given situation on the microbial culture employed. In some situations, mesophiles can tolerate higher sulfate levels than moderate and extreme thermophiles. The following threshold concentrations are mentioned with this context.

The threshold sulfate concentration may be 170 g/L sulfate in a leach liquor collected from the heap.

The threshold sulfate concentration may be 150 g/L sulfate in a leach liquor collected from the heap.

The threshold sulfate concentration may be 120 g/L sulfate in a leach liquor collected from the heap.

The threshold sulfate concentration may be 60 g/L sulfate in a leach liquor collected from the heap.

The threshold sulfate concentration may be at least 2 g/L in a start-up stage of the method.

The threshold sulfate concentration may be at least 20 g/L in a start-up stage of the method.

The threshold sulfate concentration may be 50-100 g/L in a later post-start-up leaching stage of the method.

The threshold sulfate concentration may be 60-130 g/L during the post-start-up leaching stage of the method.

The threshold sulfate concentration may be a concentration range of 100-130 g/L during the post-start-up leaching stage of the method.

The threshold sulfate concentration may be a concentration range of 110-120 g/L during the post-start-up leaching stage of the method.

The threshold sulfate concentration may be increased to the previously described threshold concentration limits.

The microbes may be added during agglomeration.

The microbes may be added in the leach liquor.

The microbes may be added during agglomeration and in the leach liquor.

The microbes may be any suitable microbes.

The microbes may be any microbes that can oxidise ferrous iron and/or sulfur compounds and include but are not limited to members of the bacterial genera *Acidithiobacillus, Leptospirillum, Sulfobacillus* and *Ferrimicrobium*, and the archaeal genera *Acidianus, Acidiplasma, Ferroplasma, Metallosphaera* and *Thermoplasma*.

Typically, the microbes are a diverse population, including microbes selected from mesophiles, moderate thermophiles and thermophiles psychrotolerant or mesophilic or thermophilic (moderate or extreme) bacteria or archaea. The microorganisms may be acidophilic bacteria or archaea. The microorganisms may be thermophilic acidophiles. A diverse population allows activity across a range of operating conditions, including high sulfate concentrations.

Heap leaching may include controlling the pH of the leach liquor to be less than 3.2, typically less than 3.0, typically less than 2.5, typically less than 2.0, typically less than 1.8, and typically less than 1.5.

Heap leaching may include controlling the pH of the leach liquor to be greater than 0.5, typically greater than 1.0.

Heap leaching may include controlling the temperature of the heap to be less than 85° C., typically less than 75° C., typically less than 65° C., typically less than 60° C., typically less than 55° C., and more typically less than 50° C. In a preferred embodiment, heap leaching includes controlling the temperature to be less than 65° C.

Heap leaching may include controlling the leach solution temperature to be above the freezing point of the leach solution, typically above 0° C., typically at least 10° C., typically at least 20° C., typically at least 30° C., typically at least 40° C., and more typically at least 50° C.

Heap leaching may include controlling the aeration rate of the heap to range from 0.01 to 0.1 $Nm^3/h/t$ ore (where t is metric tons or tonnes and N is normal temperature and pressure at sea level). The typical rate may be towards the lower end of this range Heap leaching may include controlling the aeration rate of the heap to be at least 0.25 $kg/m^2/h$ per lift, typically at least 0.25 $kg/m^2/h$ per lift, typically at least 0.75 $kg/m^2/h$ per lift, typically at least 1 $kg/m^2/h$ per lift, typically at least 2 $kg/m^2/h$ per lift, more typically ranging from 0.25 to 1.0 $kg/m^2/h$ per lift, and typically 0.25 to 2.5 $kg/m^2/h$. Suitably, each lift is about 10 m in height.

The irrigation rate may range from 1-50 $L/h/m^2$, suitably ranging from 1-20 $L/h/m^2$. Deploying sprinklers or wobblers typically result in an irrigation rate at the higher end of the range whereas deploying drippers typically result in an irrigation rate at the lower end of the range.

In one example, the heap leaching includes maintaining the average aeration rate and average irrigation rate at a ratio in the range of 0.125:1 to 5:1, typically in the range of 0.15:1 to 2:1, typically in the range of 0.175:1 to 1.5:1, and more typically in the range of about 0.2:1.

In another example, heap leaching includes maintaining the instantaneous aeration rate and instantaneous irrigation rate at a ratio in the range of 0:1 to 5:1, typically in the range of 0:1 to 2:1, typically in the range of 0:1 to 1.5:1, and more typically of about 0.2:1.

The aeration rate may be set to maintain a predetermined oxygen utilisation of the heap.

In one example, heap leaching includes controlling the aeration rate to maintain an oxygen utilisation of the heap in the range of 1% to 99%, typically in the range of 15% to 90%, more typically in the range of 20% to 85%.

Heap leaching may include controlling the oxidation potential of the leach liquor during an active leaching phase to be less than 1000 mV, typically less than 900 mV, typically less than 850 mV, typically less than 800 mV, typically 500 to 750 mV, more typically in a range of 600 to 750 mV, all potentials being with respect to the standard hydrogen electrode.

The oxidation potential will change during leaching and is likely to be higher when much of the copper has been leached and the reference to "active leaching phase" is intended to acknowledge this potential change. The oxidation potential reached is also dependent on temperature and will typically be higher at lower temperatures.

The method may include an agglomeration step for forming agglomerates of fragments of copper-containing sulfidic ores or copper-containing sulfidic waste materials for subsequent heap leaching in the method.

The agglomeration step may include simultaneously mixing and agglomerating fragments of copper-containing sulfidic ores or copper-containing sulfidic waste materials.

The agglomeration step may include mixing fragments in one-step and then agglomerating the mixed fragments in a subsequent step.

There may be overlap between the mixing and agglomeration steps.

The agglomeration step may include agglomerating fragments of copper-containing sulfidic ores or copper-containing sulfidic waste materials in an agglomeration unit and may also include various combinations of the following feed materials, typically introduced at, or in close proximity to, an inlet of the unit.

The agglomeration step may include agglomerating fragments of copper-containing sulfidic ores or copper-containing sulfidic waste materials in an agglomeration unit and may also include various combinations of the following feed materials, typically introduced at, or in close proximity to, an inlet of the unit:

(a) sulfuric acid,
(b) microbes to oxidise ferrous ions and oxidise solid and soluble sulfur compounds, thereby regenerating ferric ions and acid,
(c) silver with catalyst properties to enhance leaching of copper from copper-containing sulfidic ores or copper-containing sulfidic waste materials,
(d) optionally, an activation agent to activate silver, selected from thiourea, chlorides, bromides and iodides,
(e) optionally, a complexing agent additive to enhance the dissolution of copper from copper minerals in the copper-containing sulfidic ores or copper-containing sulfidic waste materials by forming a complex between (i) sulfur, that has originated from copper minerals in the ores, and (ii) the additive,
(f) pyrite (or any other suitable material including elemental sulfur) to provide a source of ferrous ions and heat in the case of pyrite (and heat only in the case of elemental sulfur), and
(g) water and/or other water sources and/or a pregnant leach solution from a heap leaching operation or a raffinate formed in a solvent extraction operation on the pregnant leach solution.

Elemental sulfur may be a partial or complete replacement of sulfuric acid and/or pyrite.

Elemental sulfur has a number of benefits including:

(a) easier to transport and handle than pyrite;
(b) readily available; and
(c) typically, cheaper than pyrite and sulfuric acid.

The applicant has discovered that deploying elemental sulfur may allow processing of low pyrite concentration base metal sulfide-containing sulfidic material, particularly copper containing sulfidic material.

The collected leach liquor may be processed by any suitable processing option to recover copper from the leach liquor.

The invention also provides a heap of material, with the material including the above-described fragments of copper-containing sulfidic ores or copper-containing sulfidic waste materials or agglomerates of the fragments of copper-containing sulfidic ores or copper-containing sulfidic waste materials.

The heap of material may be configured for a microbial-assisted heap leaching operation.

The invention also provides a microbial-assisted heap leaching operation for fragments of copper-containing sulfidic ores or copper-containing sulfidic waste materials, the heap leaching operation comprising:

(a) a heap of fragments, typically in the form of agglomerates of fragments, of the copper-containing sulfidic ores or copper-containing sulfidic waste materials, and microbes and optionally other additives; and (b) a system that (i) supplies an acidic leach liquor containing sulfate to the heap so that the leach liquor flows downwardly though the heap and leaches copper from the copper sulfide-containing sulfidic ores or copper-containing sulfidic waste materials, (ii) collects a pregnant leach liquor containing copper in solution from the heap, with microbes oxidising ferrous iron to ferric iron, and (iii) controls the sulfate concentration in the leach liquor so that it does not exceed a threshold concentration.

The invention also provides the heap leaching operation described in the preceding paragraph as applied generally to base metal-containing sulfidic ores or base metal-containing sulfidic waste materials.

The fragments may be in the form of agglomerates of fragments and the agglomerates may comprise any one or more than one of the above-described additives, including silver, sulfuric acid, pyrite, an activation agent for silver, elemental sulfur, and a complexing additive agent.

The agglomerates may include other additives, such as a surfactant to facilitate contact of additives with solids.

When present, pyrite generates acid and heat in the heap that facilitates leaching the metal from the copper-containing sulfidic ores or copper-containing sulfidic waste materials.

It is noted that heat and acid generation is not confined to the pyrite and other sulfides (such as pyrrhotite, if present) may also generate heat and acid as by-products.

The agglomerates of fragments of the copper-containing sulfidic ores, pyrite, and microbes may be as described above.

Typically, the heap leaching operation starts at a low sulfate concentration (typically 5 g/L) and is ramped up over time.

The threshold concentration may be as described above.

The system of the heap leaching operation may be configured to measure or model oxygen utilisation of a heap.

The system may be configured to control one or more of operating parameters based on measured or modelled data to maintain the predetermined oxygen utilisation of the heap.

The system may be configured to select an aeration rate of the heap based on a desired parametric value.

The system may be configured to select an aeration rate of the heap based on a desired oxidation rate of the heap.

The system may be configured to determine an oxidation rate of copper-containing sulfidic feed material as a function of any one or more of an oxygen content of gas in the heap, the pregnant leach temperature, the heap temperature, the pregnant leach metal content, the pregnant leach stream oxidation potential, the pregnant leach oxygen concentration, a heap oxygen uptake rate, a heap carbon dioxide uptake rate, and a simulation based on at least one of a feed composition, sulfide mineral leaching rates, heap geometry, environmental conditions external to the heap, and historical values of previously leached heaps.

The system may be configured to select an aeration rate of the heap based on a desired microbial population and/or activity.

The system may be configured to select a threshold sulfate concentration in solution based on a desired microbial population and/or activity.

The system may be configured to select an aeration rate of the heap based on a desired heap temperature.

The system may be configured to monitor the temperature at different locations in the heap.

Suitably, the system is configured to monitor the temperature at a point anywhere along the height of the heap, more suitably ranging from 1-95% of the heap height below the heap surface.

The system may be configured to measure the pregnant leach liquor temperature.

The system may be configured to control an irrigation rate of the heap.

The system may be configured to aerate one of more lifts of the heap. Suitably, the system may be configured to aerate each lift of the heap.

The heap leaching operation may include a unit for processing the collected pregnant leach liquor and recovering copper from the leach liquor.

The invention also provides a heap of copper-containing sulfidic ores or copper-containing sulfidic waste material configured for a microbial-assisted heap leaching operation, the heap comprising:

a support surface, a layer of granular material located on the support surface, a layer of copper-containing sulfidic ores or copper-containing sulfidic waste materials located on the granular material layer, an irrigation system configured to supply a solution, typically a hot solution, through the granular layer, a collection system configured to collect a pregnant leach liquor containing copper in solution from the heap, an aeration system configured to supply air to the heap to react with the layer of copper-containing sulfidic ores or copper-containing sulfidic waste materials, and a control system to monitor and change one or more operating parameters to maintain a predetermined sulfate concentration.

The invention also provides the heap described in the preceding paragraph as applied generally to base metal-containing sulfidic ores or base metal-containing sulfidic waste materials.

The granular material may comprise crushed rock, sand, or gravel.

The air blown by the aeration system may be ambient air.

In some embodiments, the air blown by the aeration system is heated.

The aeration system may be located on the support surface.

The support surface may include a liner.

The operating parameters may be any one or more of an oxygen concentration of the heap, a carbon dioxide concentration of the heap, the pregnant leach liquor temperature, a heap temperature, the pregnant leach liquor metal content, the pregnant leach liquor oxidation potential, a heap oxygen uptake rate, a heap carbon dioxide uptake rate, environmental conditions external to the heap and sulfate concentration.

The heap may include a carbon source for supporting cell growth. Suitable carbon sources may include inorganic carbon sources such as carbon dioxide and carbonate and/or organic carbon sources such as yeast. The carbon dioxide may be dissolved in solution.

The heap may include a drainage system on the support surface. Adequate drainage of a heap is important to minimise or avoid phreatic build up. Phreatic build up occurs when leach liquor cannot flow, or inefficiently flows, through the heap. This causes the heap to be saturated from the bottom up and affects microbial activity.

The granular rock layer may have a P80 particle size ranging from 0.5 cm to 1 m, typically ranging from 0.5-50 cm, and typically ranging from 0.5-20 cm.

The heap may include a sulfide-containing additive.

Suitable sulfide-containing additives may include pyrite or a suitable sulfide concentrate. The additive may generate heat and acid to facilitate the leaching process.

The heap may be configured into at least two process zones, i.e., lifts, in which the leaching process is at least partly independently controlled.

The aeration system may be configured to aerate one of more lifts of the heap. Suitably, the aeration system is configured to aerate each lift of the heap.

The heap may include a cover. The cover may be made of plastic, e.g. polyethylene. The cover may comprise a biofilm (more for heat retention than other reasons). The cover may be applied on top of the heap. The cover may be applied in the heap. The cover may reduce air and heat loss. This may assist in minimising the temperature gradient across the heap.

The collection system may be any suitable system known in the art. For example, the collection system may include a pond, tank or vat and its associated plumbing, suitably with a pump, to transport the pregnant leach liquor from the heap for further processing to recover copper from the pregnant leach liquor.

The invention also provides a method of constructing a heap of copper-containing sulfidic ores or copper-containing sulfidic waste materials that is configured to maintain a predetermined sulfate concentration, the method comprising:

providing a support surface for the heap, forming a layer of granular material on the support surface, forming a layer of copper-containing sulfidic ores or copper-containing sulfidic waste materials on the granular material layer, installing an irrigation system that is configured to supply a solution, typically a hot solution, through the granular layer, installing a collection system configured to collect a pregnant leach liquor containing copper in solution from the heap, installing an aeration system that is configured to blow air to react with the layer of copper-containing sulfidic ores or copper-containing sulfidic waste materials; and installing a control system to monitor the sulfate concentration of the heap and change one or more operating parameters to maintain a predetermined sulfate concentration.

The invention also provides the method described in the preceding paragraph as applied generally to base metal-containing sulfidic ores or base metal-containing sulfidic waste materials.

The method may include a step of embedding a carbon source in the heap.

The carbon source may be added to the leach liquor and/or air stream.

The method may include installing a drainage system on the support surface.

The method may include forming a layer of granular rock on the support surface.

The method may include adding elemental sulfur or a sulfide-containing additive to the heap.

The method may include configuring the heap into at least two process zones in which the leaching process is at least partly independently controlled.

The method may include aerating one or more lifts of the heap.

The method may include aerating each lift of the heap.

The method may include installing a cover on the heap.

The cover may comprise a plastic sheet.

The cover may be a biofilm.

The cover may be applied on top of the heap.

The cover may be applied in the heap.

In this Specification:

The phrase "hot solution" refers to a solution at a temperature above ambient temperature. Suitably, a hot solution is at a temperature ranging from 30-85° C. Suitably, a hot solution is at 40° C.

The term "take-off" means a point at which the power generated in the heap rises from a fairly low rate to a higher rate in a relatively short time period; it is the system bifurcation point.

The phrase "average irrigation rate" means the total irrigation amount applied to the heap over the total duration of the leach cycle expressed as an average hourly irrigation rate per unit area.

The phrase "average aeration rate" means the total gas amount passing through the heap over the total duration of the leach cycle. The rate may be expressed per unit mass (e.g., $Nm^3/h/t$ (metric tonne)).

The phrase "instantaneous irrigation rate" means the instantaneous irrigation rate applied to the heap over any time period shorter than the total duration of the leach cycle expressed as instantaneous hourly irrigation rate per unit area.

The phrase "instantaneous aeration rate" means the instantaneous gas flow rate applied over any time period shorter than the total duration of the leach cycle expressed as instantaneous hourly aeration rate per unit area.

The terms "irrigation rate" and "aeration rate" refer to the instantaneous irrigation rate and the instantaneous aeration rate respectively, unless otherwise stated.

The term "oxygen utilization of the heap" means the total oxygen consumed within the heap expressed as a percentage of the total oxygen passed through the heap.

Invention 2

The invention is based on a finding that the formation of agglomerates of fragments of copper-containing sulfidic ores or copper-containing sulfidic waste materials with microbes in the agglomerates requires careful control of an agglomeration unit.

The invention provides a method of forming agglomerates for heap leaching copper-containing sulfidic ores or copper-containing sulfidic waste materials that includes agglomerating fragments of copper-containing sulfidic ores or waste materials and other feed materials in an agglomeration unit having an inlet end and an outlet end configured to move material along a length of the agglomeration unit from the inlet end to the outlet end, with the method including adding the feed materials at, or close to, the inlet end, typically no more than 40%, typically no more than 30%, more typically no more than 20%, of the length from the inlet end of the agglomeration unit.

The invention also provides the method described in the preceding paragraph as applied generally to base metal-containing sulfidic ores or base metal-containing sulfidic waste materials.

The method may include substantially completing formation of agglomerates a short distance from the inlet end, typically no more than 40%, of the length from the inlet end of the agglomeration unit.

The applicant has found that microbes attached to solids are more resistant to high concentrations of sulfates than microbes in solution.

Importantly, the applicant has found that a majority of microbes attach to solids.

In one embodiment, it was found that approximately 90% of microbes attach to solids and 10% are suspended in solution.

Therefore, forming agglomerates early provides a longer time for microbes to attach to solids, i.e., the agglomerates, and to be uniformly distributed within the agglomerates while in the agglomeration unit. The uniform distribution of microbes provides an opportunity for a reduced "lag phase" and more rapid initiation of leaching during heap start-up—a shorter ramp-up period for a heap leaching operation. A reduced lag phase may also be achieved by using adapted microbes.

The applicant has also found in the research and development work that, particularly when the base metal is copper, it is preferable to add the following feed materials in the agglomeration unit in addition to fragments of copper-containing sulfidic ores and/or copper-containing sulfidic waste materials ("ore/waste material fragments"):

(a) silver, with catalyst properties to enhance leaching of copper from copper-containing sulfidic ores or copper-containing sulfidic waste materials, (b) sulfuric acid, (c) microbes to oxidise ferrous ions and oxidise solid and soluble sulfur compounds, thereby regenerating ferric ions and acid, (d) optionally, an activation agent to activate silver, selected from thiourea, chlorides, bromides and iodides, (e) optionally, a complexing additive agent to enhance the dissolution of copper from copper minerals in the ores or waste materials by forming a complex between (i) sulfur, that has originated from copper minerals in the ores or waste materials, and (ii) the additive, (f) pyrite (or any other suitable material such as elemental sulfur) to provide a source of ferrous ions and heat in the case of pyrite (and heat only in the case of elemental sulfur); and (g) water and/or a pregnant leach solution from a heap leaching operation or a raffinate formed in a solvent extraction operation on pregnant leach solution.

The elemental sulfur may be a partial or complete replacement of sulfuric acid and/or pyrite.

The feed materials may be added at the same location or at different locations along the length of the agglomeration unit.

For example, typically the ore/waste material fragments are added at the inlet of the agglomeration unit.

By way of further example, typically acid is added at multiple locations along a section of the length of the agglomeration unit.

By way of further example, typically acid is added at one location and microbes are added at another location further along the length of the agglomeration unit to minimise impact of acid on microbes.

By way of further example, pyrite (if used as a feed material) is added close to the end of the short distance, i.e. typically no more than 40%, of the length from the inlet end of the agglomeration unit so that pyrite is more likely to form on exposed surfaces of agglomerates.

Some of the feed materials may be added together in a preconditioning step and mixed, with the mixture then being added to the agglomeration unit to ensure thorough mixing of these feed materials takes place prior to agglomeration. For example, ore/waste material fragments and silver (such as a silver nitrate solution) may be pre-mixed before adding the mixture to the agglomeration unit to maximise contact of the silver with copper-containing minerals in the ore/waste material fragments. For example, a pyrite concentrate slurry underflow from a thickener may be pre-mixed with ore/waste material fragments before being directed to agglomeration.

The preconditioning step may be carried out in any suitable unit, such as an agglomeration unit.

Suitably, the microbes are added last.

In one embodiment, the addition order along a section of the length of the agglomeration unit is as follows:

a mixture of ore/waste material fragments and silver nitrate (or other suitable form of silver), then water, typically in a raffinate, then acid, optionally at multiple locations, then, pyrite or elemental sulfur, then, microbes.

It is noted that the addition order may be varied, as required. For example, pyrite and microbes may be added together in the agglomeration unit.

The copper-containing sulfidic ores or copper-containing sulfidic waste materials may include naturally-occurring silver which may have catalyst properties for copper leaching. Naturally-occurring silver may be in one or more of a number of forms in copper-containing ores or copper-containing sulfidic waste materials, including but not limited to native silver, argentite ($Ag_2S$), chlorargyrite (AgCl), as inclusions of native silver in copper minerals and pyrite, and as silver sulfosalts such as tetrahedrite (Cu,Fe,Zn, $Ag_{12}Sb_4S_{13}$), pyrargyrite ($Ag_3SbS_3$) and proustite ($Ag_3AsS_3$).

The added silver may be added to the agglomeration step in any suitable form, such as in a solid form or in a solution.

The added silver may be added as a solid form in the agglomeration step that becomes mobile upon dissolution with leach liquor.

The added silver may precipitate or otherwise be deposited on the surfaces of fragments of copper-containing sulfidic ores.

The added silver may be dispersed on surfaces of fragments of copper-containing sulfidic ores or copper-containing sulfidic waste materials.

The added silver may be dispersed within the fragments of copper-containing sulfidic ores or copper-containing sulfidic waste materials.

The added silver may be in a soluble form in the agglomerates.

The added silver may be in an insoluble form or sparingly soluble form in the agglomerates.

The agglomerates may have a low total silver concentration, i.e., added and naturally-occurring silver.

The added silver concentration in the agglomerates may be less than 5 g silver per kg copper in the ore, typically less than 3 g silver per kg copper in the ore, more typically less than 1 g silver per kg copper in the ore, in the agglomerates.

The acid dose rate may be less than 100 kg $H_2SO_4$/dry t ore, typically less than 50 kg $H_2SO_4$/dry t ore, more typically less than 30 kg $H_2SO_4$/dry t ore, and may be less than 10 kg $H_2SO_4$/dry t ore or less than 5 kg $H_2SO_4$/dry t ore. Typically, the acid dose rate is 0.5-30 kg $H_2SO_4$/dry t ore.

The microbes may be any suitable microbes.

The microbes may be any microbes that have the ability to oxidise ferrous iron and/or sulfur compounds and include but are not limited to members of the bacterial genera *Acidithiobacillus, Leptospirillum, Sulfobacillus* and *Ferrimicrobium*, and the archaeal genera *Acidianus, Acidiplasma, Ferroplasma, Metallosphaera* and *Thermoplasma.*

Typically, the microbes are a diverse population, including microbes selected from mesophiles, moderate thermophiles and thermophiles psychrotolerant or mesophilic or thermophilic (moderate or extreme) bacteria or archaea. The microorganisms may be acidophilic bacteria or archaea. The microorganisms may be thermophilic acidophiles. A diverse population allows activity across a range of temperatures.

The complexing additive agent may be any suitable agent.

By way of example, the complexing additive agent may be a nitrogen-containing agent that includes at least two nitrogen atoms spaced by two carbon atoms to permit the additive to form complexes between sulfur, that has originated from copper minerals in the ores, and the agent.

The pyrite may be in any suitable form, such as a solid form or a slurry form.

The pyrite may be 1-25 wt. % of the total mass of the agglomerates.

The pyrite may be 1-20 wt. % of the total mass of the agglomerates.

The pyrite may be 1-10 wt. % of the total mass of the agglomerates.

The pyrite may be obtained from any suitable source. It may already be contained in the ores or the waste materials.

For example, the pyrite may be in tailings, i.e., a pyrite-containing slurry, from a tailings dam or an ore processing plant, of a mine with the slurry being used directly in the agglomeration step. Also, for example, the pyrite may be in a flotation concentrate produced from tailings.

The term "ore processing plant" is understood herein to mean any suitable plant for recovering a metal from a mined ore.

The pyrite particles may be any suitable size.

The pyrite particles in the pyrite-containing material may have a particle size of P80 of 1 mm or a value<1 mm.

The pyrite particles in the pyrite-containing material may have a particle size of P80 of 250 μm or a value<250 μm.

The invention also provides a heap of material, with the material including the above-described agglomerates of copper-containing sulfidic ores or fragments of copper-containing sulfidic waste material.

The invention also provides a microbial-assisted heap leaching operation for copper-containing sulfidic ores or copper-containing sulfidic waste materials, the heap leaching operation comprising:

(a) a heap of the above-described agglomerates of copper-containing sulfidic ores or copper-containing sulfidic waste materials; and (b) a system that (i) supplies an acidic leach liquor to the heap so that the leach liquor flows downwardly though the heap and leaches copper from the copper sulfide-containing sulfidic ores or copper-containing sulfidic waste materials and (ii) collects a pregnant leach liquor containing copper in solution from the heap, with microbes oxidising ferrous iron to ferric iron.

The invention also provides the operation described in the preceding paragraph as applied generally to base metal-containing sulfidic ores or base metal-containing sulfidic waste materials.

General

The copper-containing sulfidic ores or copper-containing sulfidic waste materials may be derived from any suitable mined ROM material.

The term "mined ROM material" is understood herein to include fragments of ROM material, which may be ROM ore or ROM waste materials, that are transferred from a location in a mine in which the ROM material is mined:

i. directly to a heap; or ii. directly to a stockpile and then transferred later directly to the heap; or iii. for intermediate processing as described herein and then transferred to the heap; or iv. for intermediate processing as described herein and then transferred to a stockpile and then transferred later to the heap; or v. directly to a stockpile and then transferred for intermediate processing as described herein and then transferred to the heap; or vi. a combination of the preceding options iv. and v. with intermediate processing before and after the stockpile.

As noted above, the ROM material may be fragments that are reduced in size as a consequence of mining and transferring ROM material from a mine to a heap, a stockpile or an intermediate processing plant, and not as a consequence of a specific comminution step.

One example of copper-containing sulfidic ores is rocks that contain low concentrations of copper.

The copper-containing sulfidic ores may be in the form of as-mined material or stockpiles of copper-containing sulfidic ores having low grades, i.e., low concentrations, of copper in the material.

The term "low grade" as used in relation to "copper-containing sulfidic ores" mentioned above is understood herein to be a term that is dependent on currently available technology and the current price of copper, and that material currently considered "low grade" may be considered valuable material in the future depending on technological developments and the future price of copper.

In the context of the preceding paragraphs, the term "low concentrations of copper" is understood to mean an average copper concentration of <1.5% by weight, typically <1.2 wt. %, more typically <1.0 wt. %, even more typically <0.7 wt. %, even more typically 0.5 wt. %, even more typically <0.3 wt. %, even more typically 0.1 wt. %.

The method may include reducing the size of the as-mined or stockpiled copper-containing sulfidic ores prior to agglomeration.

The method may include comminution of as-mined or stockpiled copper-containing sulfidic ores and producing a suitable particle size distribution for the agglomeration step.

The comminution step may include crushing as-mined or stockpiled copper-containing sulfidic ores in one or more than one comminution circuit that reduces the size of the material.

The comminution step may include crushing as-mined or stockpiled copper-containing sulfidic ores successively in primary, secondary and tertiary comminution circuits, as these terms are understood by persons in the copper mining industry.

The comminution step may include single or multiple crushing steps delivering crushed as-mined or stockpiled copper-containing sulfidic ores to produce the material with a desired particle size distribution for the agglomeration step.

By way of example, the term "primary crushing" is understood herein to mean crushing copper-containing sulfidic ores to a top size of 300 mm. It is noted that the top size may be different for ores containing different valuable metals.

The above description in relation to copper-containing sulfidic ores under the heading "General" applies equally to copper-containing sulfidic waste materials and ROM ore.

DESCRIPTION OF THE DRAWINGS

The invention is described further with reference to the accompanying drawings of which.

DESCRIPTION OF EMBODIMENT

The following description is in the context of heap leaching agglomerates of fragments of copper-containing sulfidic ROM material in the form of ores.

The following description is in the context of microbial-assisted heap leaching copper-containing sulfidic ores with a leach liquor.

Figure 1:
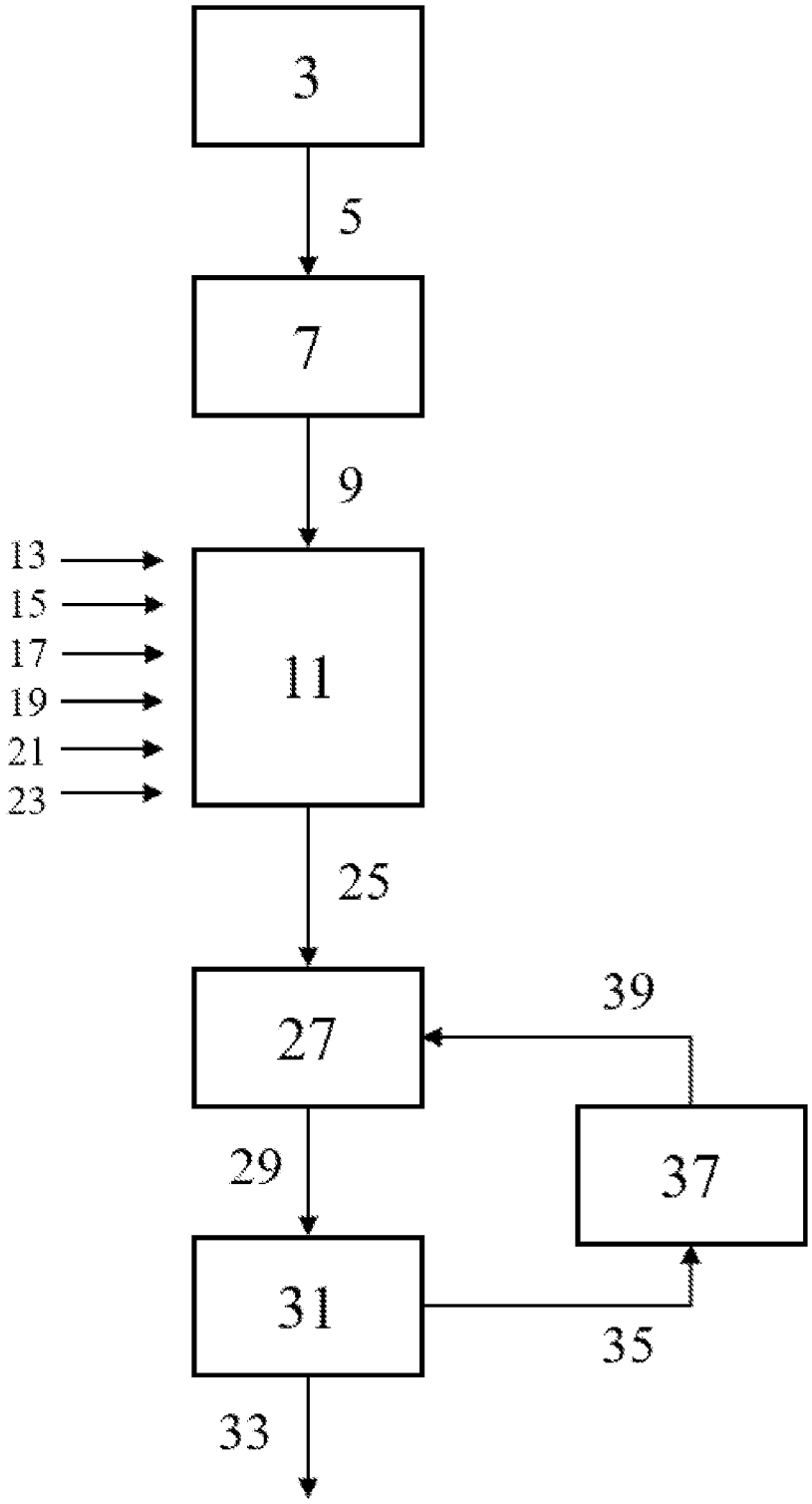
FIG. 1 illustrates the steps of a method of microbial-assisted heap leaching agglomerates of fragments of copper-containing sulfidic ores that contains chalcopyrite ($CuFeS_2$), enargite ($Cu_3AsS_4$), tetrahedrite ($Cu,Fe,Zn,Ag_{12}Sb_4S_{13}$), tennantite ($Cu_{12}As_4S_{13}$), chalcocite ($Cu_2S$), covellite ($CuS$), bornite ($CusFeS_4$) or any combination thereof, or other copper containing sulfide minerals, with a leach liquor in accordance with an embodiment of the invention.

The flow sheet of FIG. 1 shows the steps in one embodiment of a method of microbial-assisted heap leaching agglomerates of fragments of copper-containing sulfidic ores that contain chalcopyrite and/or enargite with a leach liquor.

With reference to FIG. 1, copper-containing sulfidic ROM ores 5, such as ore containing chalcopyrite and/or enargite, from a mine 3 is crushed in a crusher 7. The ore is crushed to fragments having a suitable particle size distribution for downstream processing of the fragments. Crushed ore fragments 9 are transferred to an agglomeration unit 11 and formed into agglomerates 25 of fragments of crushed copper containing ore. The agglomerates 25 are transferred to a heap 27. A leach liquor 39 is supplied to an upper surface of the heap 27 and allowed to percolate through the heap 27 and take copper into solution. A pregnant leach liquor 29 containing copper in solution is collected from the heap and processed in a copper recovery circuit 31. The circuit 31 may be a solvent extraction and electrowinning circuit. A copper product 33 is produced in the circuit 31. A spent leach liquor 35, i.e., a raffinate in situations where the circuit 31 is a SX circuit, is transferred to a regeneration circuit 37. Any one or more of water, acid, microbes, and other additives are added as required to produce a regenerated leach liquor 39, which is returned to the heap 27.

Figure 2:
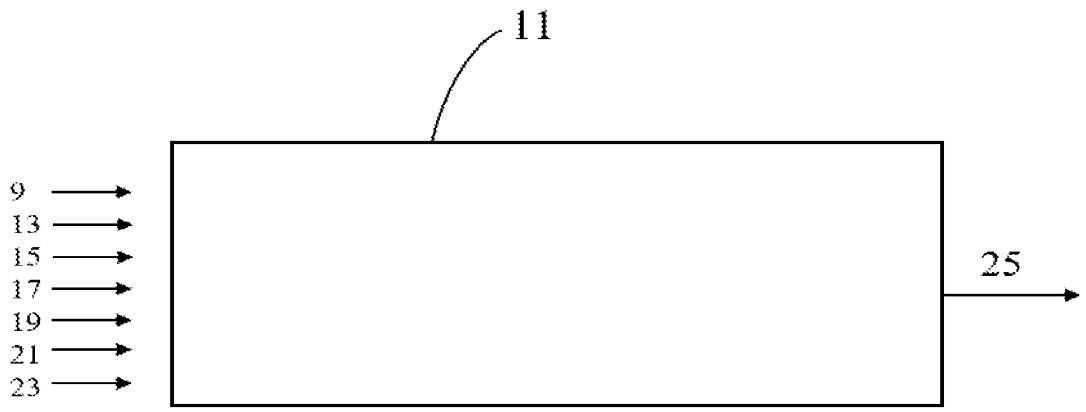
FIG. 2 is a schematic diagram of an agglomeration unit for producing agglomerates of fragments of copper-containing sulfidic ores in accordance with an embodiment of the invention.

With reference to FIGS. 1 and 2, in this embodiment, the following feed materials are transferred to the agglomeration unit 11 and are mixed together and form agglomerates in the unit 11, with the feed materials being added at, or close to, an inlet of the unit 11 and forming agglomerates a short distance along the length of the unit, typically within 40% of the length of the unit 11:

(a) the above-mentioned crushed fragments 9 of copper-containing sulfidic ores, (b) silver 13 with catalyst properties to enhance leaching of copper from copper-containing sulfidic ores, in this embodiment provided as a silver solution (but could be in a solid form), typically having an added concentration of silver of less than 5 g silver per kg copper in the ore in the agglomerates, where added concentration means the concentration of silver in addition to the concentration of naturally occurring silver in the ores, (c) acid 15, typically sulfuric acid in any suitable concentration, (d) microbes 17 of any suitable type and in any suitable concentration to oxidise ferrous ions and oxidise solid and soluble sulfur compounds, thereby regenerating ferric ions and protons, (e) an activation agent 19 for silver, typically thiourea, chlorides, bromides or iodides, (f) an additive 21 to enhance the dissolution of copper from copper minerals in the ores by forming a complex between (a) sulfur, that has originated from copper minerals in the ores, and (b) the additive, (g) pyrite 23 (or any other suitable material) to provide a source of ferrous ions and heat, in this embodiment, is tailings-derived pyrite-containing concentrate—typically a concentration range of 1-20% pyrite in the agglomerates 25, and (h) water from any suitable water source (not shown).

As is described further below, the feed materials may be added at the same time or in any suitable order.

Typically, the microbes are added last.

In some embodiments, the microbes are added last and furthest from the inlet of the agglomeration unit 11.

It is noted that the invention is not confined to the use of all of the above additives.

In addition, it is noted that the invention extends to the use of other additives.

For example, an optional additive is a surfactant to facilitate contact of additives with solids.

The agglomeration unit 11 may be any suitable agglomeration unit, such as a drum having an inlet end and an outlet end that is mounted at an inclined angle for rotation about an elongate axis of the drum with the inlet at a higher level than the outlet so that the material added to the drum tends to move downwardly along the drum to the outlet.

The above-mentioned agglomeration unit feed materials, namely crushed ore fragments 9, silver 13, acid 15, microbes 17, activation agent 19, and complexing additive 21, pyrite 23 and water (as required—typically raffinate or fresh water) are added at or close to the inlet end of the agglomeration unit 11, typically no more than 40%, typically no more than 30%, more typically no more than 20%, along the length of the drum.

Typically, the above addition of feed material results in substantially complete formation of agglomerates a short distance, typically no more than 40%, along the length of the drum.

In one embodiment, the addition order along a section of the length of the agglomeration unit 3 is as follows:

a mixture of ore/waste material fragments and silver nitrate (or other suitable form of silver),
then water, typically in a raffinate but could be fresh water,
then acid, optionally at multiple locations,
then, pyrite or elemental sulfur,
then, microbes.

The addition order may be varied, as required. For example, pyrite and microbes may be added together in the agglomeration unit 3.

The agglomeration unit feed materials may be added to the agglomeration unit 11 in any suitable way.

For example, silver 13 may be added as a solution in a fine mist or spray or as solid particles in an aerosol. The applicant has found that this is a particularly suitable way of achieving a desirable dispersion of silver on the ore fragments—see International publication WO2017/070747 in the name of the applicant and the disclosure is incorporated herein by cross-reference. The selection of a mist/spray/aerosol as a medium for adding silver to the chalcopyrite ore fragments makes it possible to maximise the delivery of a small concentration of the silver to a substantially larger mass (and large surface area) and to a substantial proportion of the chalcopyrite (or other copper sulfide minerals) ore fragments.

The agglomeration unit feed materials may be added to the agglomeration unit 11 in any suitable concentrations having regard to a range of factors including, for example, mineralogy of the ore, the particle size distribution of the ore fragments, the dimensions (length and diameter of the drum), the target throughput for the agglomeration unit 3, the anticipated attrition of agglomerates in the drum, and the required mechanical properties of the agglomerates.

For example, the complexing additive 21 may be added to the drum or to the leach liquor 39 in concentrations up to 10 g/L, up to 5 g/L, up to 2.5 g/L, up to 1.5 g/L, up to 1.25 g/L, or up to 1 g/L, in the leach liquor. When the additive is a polymer-like additive, such as longer chain organic substances, such as polyethyleneimine (PEI), it may be preferred to add the additive while forming agglomerates in the agglomeration station 3 rather than adding the additive to leach liquor.

Mixing and agglomerating the feed materials for the agglomerates 25 may occur simultaneously.

Alternatively, mixing the feed materials may be carried out first and agglomerating (for example initiated by the addition of the acid 15) may be carried out after mixing has been completed to a required extent.

Moreover, the timing of adding and then mixing and agglomerating feed materials may be selected to meet the end-use requirements for the agglomerates 25. For example, it may be preferable in some situations to start mixing fragments containing chalcopyrite and then adding silver in a solution or in a solid form of silver, acid, and microorganisms progressively in that order at different start and finish times in the agglomeration step. By way of particular example, it may be preferable in some situations to start mixing fragments containing chalcopyrite and then adding silver in a solution or in a solid form and acid together, and then adding microorganisms at different start and finish times in the agglomeration step.

The feed materials may be added at the same location or at different locations along the short distance along the length of the agglomeration unit, typically no more than 40%, of the length from the inlet end of the agglomeration unit. For example, typically acid 15 is added at one location and microbes 17 are added at another location further along the length of the agglomeration unit to minimise impact of acid on microbes. By way of further example, pyrite 23 is added close to the end of the short distance so that pyrite is more likely to form on exposed surfaces of the agglomerates 25. In addition, there may be multiple locations for adding portions of the same additive.

Some of the additives may be premixed with ore just prior to agglomeration. This provides more thorough mixing. In one example, ore is mixed with pyrite concentrate thickener underflow slurry ahead of agglomeration.

The agglomerates 25 produced in the agglomeration unit 11 may be transferred directly to a construction site for the heap 27. Alternatively, the agglomerates 25 may be stockpiled and used as required for the heap 27—for example, added to successive lifts of the heap 27. The agglomeration unit 11 and the heap 27 are typically in close proximity. However, this is not essential and may not be the case.

The method of agglomerating mined ore fragments described above is suitable for forming agglomerates that can be used in standard heaps.

The invention is not confined to particular shapes and sizes of heaps and to particular methods of constructing heaps from the agglomerates and to particular operating steps of the heap leaching processes for the heaps.

By way of example only, the heap 27 may be a heap of the type described in International publication WO2012/031317 in the name of the applicant and the disclosure of the heap construction and leaching process for the heap in the International publication is incorporated herein by cross-reference.

The heap 27 may be any suitable heap construction and is provided with:

(a) a leach liquor storage and delivery system to supply leach liquor 39 to an upper surface of the heap;
(b) a pregnant leach liquor collection system for collecting leach liquor 29 containing copper in solution that is extracted from copper sulfide-containing materials in agglomerates 25 in the heap 27; and
(c) additional microbes (such as bacteria or archaea) or other suitable oxidants to oxidise ferrous iron to ferric iron, with the ferric iron and protons breaking down the mineral matrix and solubilising copper.

In one example, the heap 27 comprises a support surface, a layer of granular material comprising crushed rock having a P80 particle size ranging from 30 mm to 2000 mm and a layer of chalcopyrite-containing feed material. The purpose of the crushed rock is to allow drainage of leach liquor. The feed material comprises the above-described agglomerates. The feed material may also comprise tailings produced by processing of the chalcopyrite feed material in another copper-recovery method.

The layer of chalcopyrite-containing feed material forms an initial lift of feed material to be leached.

In use, when leaching of the initial lift reaches a selected point, a new layer of the feed material is added to the heap to form a new lift that is subsequently leached, and so on.

An aeration system located on the support surface is used to blow ambient air through each lift at or near the base of the first lift and optionally at the base of subsequent lifts to react with the feed material. In addition, an irrigation system located on top of the heap is configured to supply an irrigation solution which can include nutrients for the microbes and pyrite to facilitate the leaching process and to maintain the heap at a temperature ranging from 40-70° C.

A control system monitors and changes one or more operating parameters to maintain a predetermined sulfate concentration in the leach liquor. The operating parameters may be controlled to ensure that the sulfate concentration in the leach liquor does not exceed a threshold concentration of 170 g/L sulfate in leach liquor collected from the heap. The irrigation solution may be dosed with a carbon source such as carbon dioxide, carbonate, or yeast. A cover comprised of a plastic sheet or a biofilm may be applied on top of the heap to reduce air and heat loss and minimise temperature gradient across the heap.

A drainage system is also installed on the support surface to avoid phreatic build up.

The heap operation includes controlling the operation so that the sulfate concentration in the leach liquor does not exceed a threshold concentration.

As noted above, the applicant has found that it is possible to operate a microbially-assisted heap leach of agglomerates of fragments of copper-containing sulfidic ores or copper-containing sulfidic waste materials with high sulfate concentrations in the acidic leach liquor.

The sulfate concentration can be controlled in a number of ways.

One way is to control the aeration rate of the heap. Doing so regulates the amount of oxygen into the heap and consequently, the amount of oxygen supplied to the microbes. The aeration rate was controlled to provide a microbial population that is sufficient to ensure that the leach liquor collected from the heap does not exceed a threshold concentration of 170 g/L sulfate.

The above finding is indicated by the results of experimental work summarised in FIGS. 3 to 7.

Figure 3:
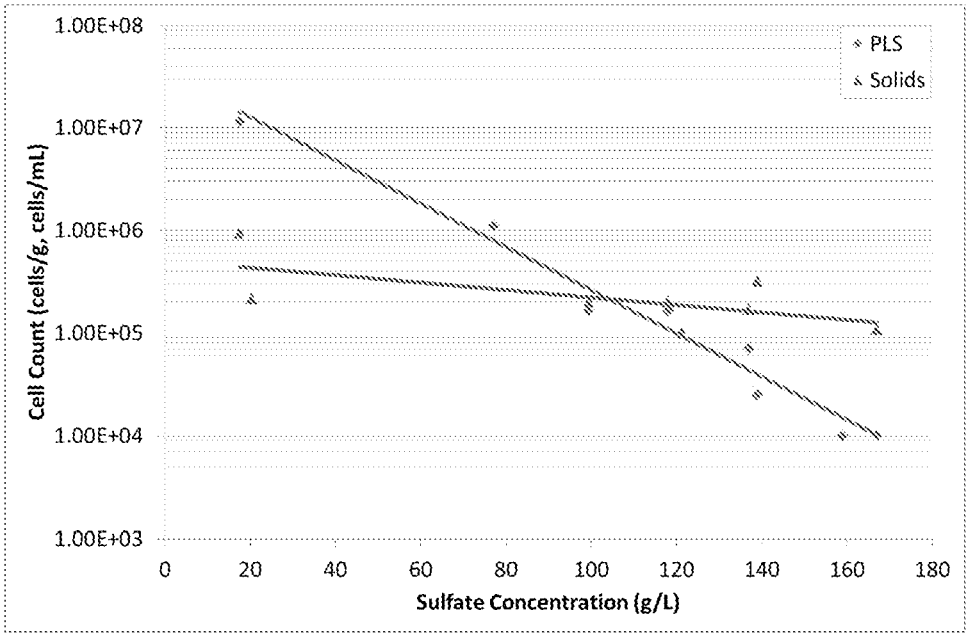
FIG. 3 is a graph of microbe count versus sulfate concentration for microbes in pregnant leach liquor and on solids which shows the effect of solution sulfate concentration on the cell population in solution and on ore solids for a 50° C. moderate thermophile microbes.

FIG. 3 is a graph of microbe count versus sulfate concentration for microbes in pregnant leach liquor and on solids which shows the effect of solution sulfate concentration on the cell population in solution and on ore solids for 50° C. moderate thermophile microbial cultures, typically containing up to 20 different species of microbes. The Figure, noting the logarithmic y-axis shows that the cell count for this culture declined more slowly with increasing sulfate concentration for microbes on solids. There was a steeper decline in cell count for microbes in pregnant leach liquor. This indicates that microbes attached to solids are more sulfate tolerant than microbes in solution. Attachment of microbes on solids is important in terms of maintaining high enough cells count at higher sulfate concentrations to enable heap leaching to take place at commercially practical rates.

Figure 4:
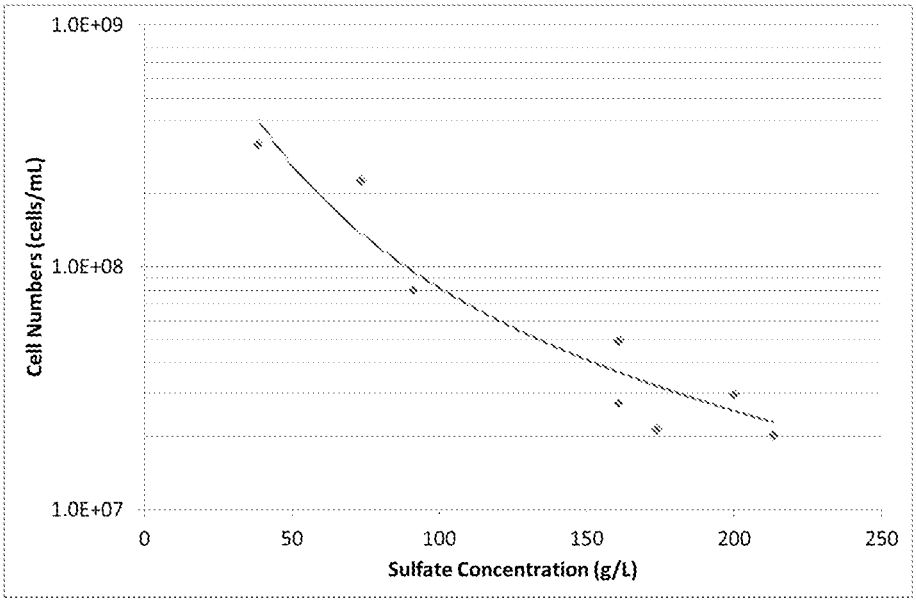
FIG. 4 is a graph of microbe count versus sulfate concentration for microbes which shows the maximum bacterial cell concentration vs sulfate concentration for 60° C. extreme thermophile microbes.

FIG. 4 is a graph of microbe count versus sulfate concentration for microbes which shows the maximum bacterial cell concentration vs sulfate concentration for a 60° C. extreme thermophile microbial culture. The FIG. 4 culture has a higher cell in solution population over the entire sulfate concentration range compared to the FIG. 3 culture. Comparing Figures, and taking into account that tests were done using differing samples and growth techniques, shows that the cells in solution of FIG. 4 are more sulfate tolerant than the 50° C. cells in solution of FIG. 3.

Figure 5:
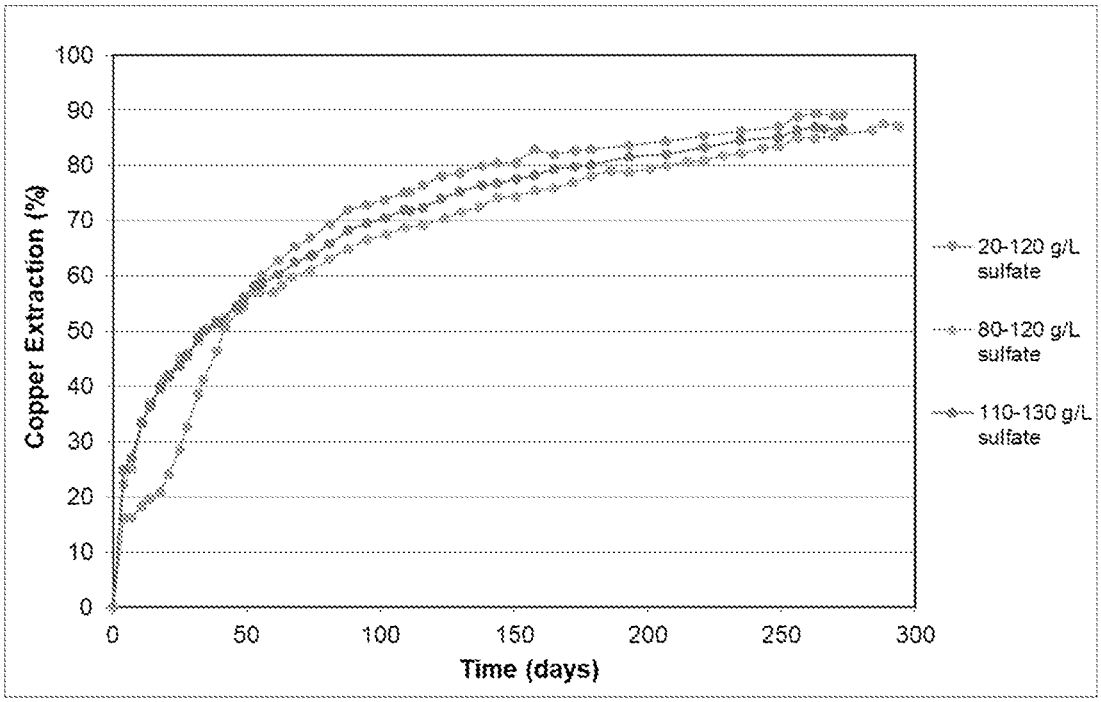
FIG. 5 is a graph of copper extraction versus time with leach solutions having different sulfate concentrations which shows the effect of starting solution sulfate concentrations (first value in the legend) and maximum sulfate operating level (second value) on copper extraction from a primary copper sulfide dominant ore in a column test operated at 60° C.

FIG. 5 is a graph of copper extraction versus time in column tests operated on a chalcopyrite dominant copper ore at 60° C. using an extremely thermophilic microbial culture with leach solutions having different starting (first value in the legend) and maximum operating level (second value) sulfate concentrations. Similar high copper extractions (86-89%) were achieved for all three tests. The results demonstrate the excellent performance of this culture over a broad sulfate operating range and high sulfate threshold concentrations.

Figure 6:
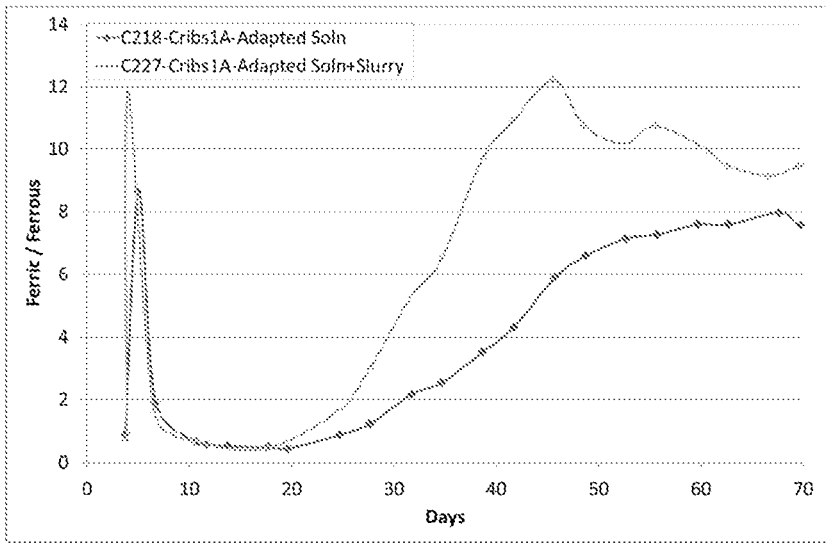
FIG. 6 is a graph of ferric to ferrous ratio versus time for columns inoculated with adapted inoculum solution (C218) and adapted inoculum slurry during agglomeration (C227)

FIG. 6 is a graph of ferric to ferrous ratio versus time for columns operated on a copper ore inoculated with adapted inoculum solution (C218) and adapted inoculum solution plus slurry added during agglomeration (C227). The columns were leached with a ferric iron containing starting solution. The ferric to ferrous ratio declined initially due to reaction of ferric with sulfide minerals, followed by a lag period, after which the ferric to ferrous ratio increased rapidly due to the onset of high microbial activity. The column inoculated with adapted inoculum solution plus slurry exhibited a shorter lag period, indicative of high microbial activity occurring sooner, than in the column inoculated with adapted inoculum solution.

Figure 7:
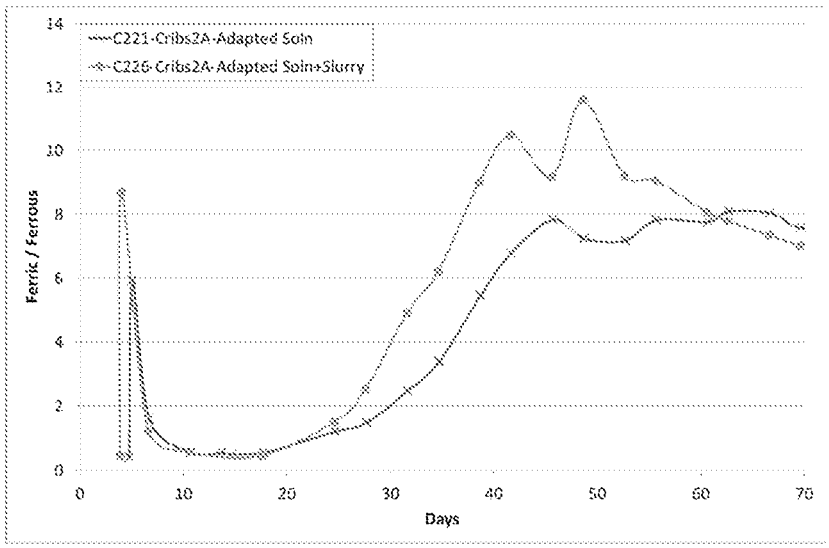
FIG. 7 is a graph of ferric to ferrous ratio for columns inoculated with adapted inoculum solution (C221) and adapted inoculum slurry during agglomeration (C226).

FIG. 7 is a graph of ferric to ferrous ratio for another set of columns operated on a different copper ore, inoculated with adapted inoculum solution (C221) and adapted inoculum slurry during agglomeration (C226). The results obtained were similar to those depicted in FIG. 6.

Many modifications may be made to the embodiment of the invention as described above with reference to the Figures without departing from the spirit and scope of the invention.

By way of example, whilst the embodiment is described in the context of intermediate processing of fragments of copper-containing sulfidic ROM ores 5 by crushing and then agglomerating in the crusher 7 and the agglomeration unit 15, the invention also extends to other intermediate processing steps, such as grade sorting or size separation (for example on screens).

By way of example, whilst the embodiment is described in the context of heap leaching agglomerates of fragments of copper-containing sulfidic ROM material in the form of ores, the invention also extends to heap leaching non-agglomerated ore fragments.

By way of example, whilst the embodiment is described in the context of heap leaching agglomerates of fragments of copper-containing sulfidic ROM material in the form of ores, the invention also extends to heap leaching agglomerated or non-agglomerated fragments of ROM material in the form of waste materials.

By way of example, whilst the embodiment is described in the context of fragments of copper-containing sulfidic ROM ores 5 being transferred directly for intermediate processing by crushing and then agglomerating in the crusher 7 and the agglomeration unit 15 respectively, the invention also extends to embodiments in which fragments of copper-containing sulfidic ROM ores 5 are transferred first to a stockpile (not shown) and held in the stockpile until being transferred (a) directly to a heap or (b) to intermediate processing, such as crushing and then agglomerating in the crusher 7 and the agglomeration unit 15 respectively, before being transferred to a heap.

By way of example, the invention also extends to embodiments in which (a) there is intermediate processing (for example crushing) of fragments of copper-containing sulfidic ROM ores 5, (b) the intermediate processed ROM ores are transferred to and stored in a stockpile, (c) there is intermediate processing (such as agglomeration) of the stockpiled intermediate processed ROM ores and (d) the agglomerates are transferred to a heap and leached in the heap.

The invention claimed is:

1. A method of microbial-assisted heap leaching of base metal-containing sulfidic ores or base metal-containing sulfidic waste materials which includes: supplying an acidic leach liquor containing sulfate to a heap of fragments of base metal-containing sulfidic ores or base metal-containing sulfidic waste materials or agglomerates of fragments and allowing the leach liquor to flow through the heap and leach base metal from fragments, collecting leach liquor from the heap, and processing collected leach liquor and recovering base metal from the leach liquor, with any one or more of the fragments, agglomerates of the fragments, and the leach liquor containing microbes, and the method further includes monitoring a sulfate concentration in the leach liquor collected from the heap and controlling an operating parameter of the heap so that an amount of sulfate generated in the heap does not exceed a threshold sulfate concentration.

2. The method defined in claim 1 includes indirectly controlling a parameter other than sulfate concentration that influences a sulfate generation rate, such that changing the parameter causes a known change to the sulfate concentration.

3. The method defined in claim 1 wherein the threshold sulfate concentration is 170 g/L sulfate in a leach liquor collected from the heap.

4. The method defined in claim 1 wherein the threshold sulfate concentration is at least 20 g/L in a leach liquor collected from the heap in a start-up stage of the method.

5. The method defined in claim 1 wherein the threshold sulfate concentration is 50-100 g/L in a leach liquor collected from the heap in a later post-start-up leaching stage of the method.

6. The method defined in claim 1 includes controlling the temperature of the heap to be less than 85° C.

7. The method defined in claim 1 includes an agglomeration step for forming agglomerates of fragments of copper-containing sulfidic ores or copper-containing sulfidic waste materials for subsequent heap leaching in the method.

8. The method defined in claim 7, wherein the agglomeration step includes adding microbes.

9. The method defined in claim 1 wherein, when the base metal is copper, and the heap includes other feed materials including at least one of:

(a) silver with catalyst properties to enhance leaching of copper from copper-containing sulfidic ores or copper-containing sulfidic waste materials, (b) sulfuric acid, (c) microbes to oxidize ferrous ions and oxidize solid and soluble sulfur compounds, thereby regenerating ferric ions and protons, (d) optionally, an activation agent to activate silver, selected from thiourea, chlorides, bromides and iodides, (e) optionally, a complexing additive agent to enhance the dissolution of copper from copper minerals in the ores or waste materials by forming a complex between (i) sulfur, that has originated from copper minerals in the ores, and (ii) the complexing additive agent, (f) pyrite or elemental sulfur to provide a source of ferrous ions (pyrite), acid and heat (both pyrite and elemental sulfur), and (g) one or more of water and/or other water sources, pregnant leach solution from a heap leaching operation, a raffinate formed in a solvent extraction operation on pregnant leach solution.

10. The method defined in claim 1 including controlling an aeration rate of the heap so as to control the amount of sulfate generated in the heap.

11. The method defined in claim 1, including controlling an aeration rate of the heap in the range of 0.01-0.05 $Nm^3/h/t$ ore.

12. The method defined in claim 1, including aerating each lift of the heap.

13. The method defined in claim 1, including controlling an aeration rate of the heap to be at least 0.25 $kg/m^2/h$ per lift.

14. The method defined in claim 1, including controlling a pH in the heap in a range that induces precipitation of sulfate salts.

15. The method defined in claim 1, including controlling a pH in the heap in a range that induces precipitation of jarosite.

16. The method defined in claim 1, including controlling an irrigation rate using a rest-rinse cycle.

17. The method defined in claim 16, wherein a duration of a rest step of the rest-rinse cycle is less than a duration of a rinse step of the rest-rinse cycle.

18. The method defined in claim 16, wherein a duration of a rest step of the rest-rinse cycle is the same as or longer than a duration of a rinse step of the rest-rinse cycle.

19. The method defined in claim 1, including controlling the operating parameter based on measured or modelled data.

* * * * *